US006409139B1

(12) United States Patent
Du Pree

(10) Patent No.: US 6,409,139 B1
(45) Date of Patent: Jun. 25, 2002

(54) ADJUSTABLE HEIGHT CLOSET ROD SUPPORT

(76) Inventor: Paul J. Du Pree, 2308 31st Ave. South, Seattle, WA (US) 98144

( * ) Notice: Subject to any disclaimer, the term of this patent is extended or adjusted under 35 U.S.C. 154(b) by 0 days.

(21) Appl. No.: 09/576,506

(22) Filed: May 23, 2000

(51) Int. Cl.[7] ..... A47F 5/00
(52) U.S. Cl. ..... 248/354.1
(58) Field of Search ..... 248/354.1, 354.4, 248/354.5, 354.6, 354.7, 351, 200.1, 188.5

(56) References Cited

U.S. PATENT DOCUMENTS 2,760,745 A * 8/1956 McCleery ..... 248/200.1
2,937,842 A * 5/1960 Meek ..... 248/354.4
3,161,264 A * 12/1964 Isaacson ..... 248/351
3,333,808 A * 8/1967 Du Boff ..... 248/200.1
3,822,850 A * 7/1974 Elias ..... 248/200.1
5,150,868 A * 9/1992 Kaden ..... 248/343
5,303,894 A * 4/1994 Deschamps et al. ..... 248/343
5,388,848 A * 2/1995 Silva et al. ..... 248/300

* cited by examiner

*Primary Examiner*—Ramon O Ramirez
(74) *Attorney, Agent, or Firm*—Law Offices of Jan Carol Little

(57) ABSTRACT

An adjustable height rod support provides vertical support to rods, such as clothes closet rods, shower curtain rods, towel racks, etc. An embodiment of the rod support includes a housing, a spring, an insert, and a cradle. The spring and insert fit into the housing. The cradle is mounted on the insert. The apparatus is placed under the rod to provide vertical support. When the cradle receives the rod, the spring compresses commensurate with the weight of the rod and any items on the rod. The adjustable height rod support supports the weight of the rod and any items on the rod, thereby relieving stress on the rod itself, as well as the walls, brackets, etc., used to mount rod. The apparatus uses no mounting hardware for installation so it can be installed easily, without tools or fasteners. The apparatus is adjustable to various heights. The apparatus is light weight and thus portable.

13 Claims, 4 Drawing Sheets

ADJUSTABLE HEIGHT CLOSET ROD SUPPORT

TECHNICAL FIELD

The invention is related generally to closet rod supports and, in particular, to an adjustable height closet rod support.

BACKGROUND OF THE INVENTION

Closets in older homes usually are supported by brackets mounted on the closet walls. One such support bracket is disclosed in U.S. Design Pat. No. Des. 319, 573 to Rogers ("Rogers"). Using the support bracket in Rogers involves positioning the closet rod ends inside each of the support brackets.

A disadvantage of this configuration is that as more clothing is hung the closet rod may weaken. When weakened, the closet rod may sag. The sagging causes the clothing to move toward the center of gravity. As a result, the clothing can become wrinkled due to lack of sufficient spacing between items. The closet rod may even break. When this happens, all the clothing is spilled onto the closet floor. Cleaned and ironed clothes become soiled and wrinkled. This is particularly troublesome in older homes whose closet rods have lost some of their strength.

Alternatively, the brackets may be loosened from the closet walls. When this happens, the closet walls may become damaged. The closet rod leans and the clothes migrate to the new center of gravity on the closet rod, again resulting wrinkling of the clothes due to lack of sufficient spacing.

The brackets also may separate completely from the closet walls. This usually results in gaping holes in the walls. Additionally, the clothes fall to the closet floor and become soiled and wrinkled. This is particularly troublesome in homes whose walls are made from sheet rock. What is needed, therefore, is a closet rod support that overcomes these disadvantages.

SUMMARY OF THE INVENTION

Presented herein is a rod support. One embodiment includes an apparatus with a housing, a spring, an insert, and a cradle. The spring and insert fit into the housing. The cradle is mounted on the insert. The apparatus is placed under a rod to provide vertical support. When the cradle receives the rod, the spring compresses commensurately with the weight of the rod and any items on the rod. The rod supports the weight of the rod and any items on the rod, thereby relieving stress on the rod itself, as well as the walls, brackets, and other hardware used to mount rod.

Another embodiment includes a housing, an insert positioned inside the housing, and a rod cradle mounted to the insert. The insert and housing are threaded such that the insert screws into the housing.

One feature of the invention is that there is no mounting hardware needed to install the rod support. The advantage of this feature is that the rod support can be installed easily, without tools or fasteners.

Another feature of the invention is that it is adjustable to various heights. This is advantageous because closets are not all the same size. For example, in homes with high ceilings and correspondingly high closet rods, the apparatus height can be raised accordingly. The same is true for homes with low or average height ceilings. That is, the apparatus height can be lowered as needed. Thus, the rod support easily fits into most any space, whether within a closet in a home with cathedral ceilings, in a bungalow, a bath house, etc.

Another feature of the invention is its light weight. Its light weight adds to its portability.

Further features and advantages of the invention as well as the structure and operation of various embodiments are described in detail below.

BRIEF DESCRIPTION OF THE FIGURES

The invention is best understood by reference to the figures wherein references of like reference numbers indicate identical or functionally equivalent elements. In addition, the leftmost digits refer to the figure in which the reference first appears in the accompanying figures, in which.

DETAILED DESCRIPTION OF THE INVENTION

Example Environment

An adjustable height closet rod support is described herein. In the following description, numerous specific details, relationships, and methods are set forth to provide a full understanding of the invention. One skilled in the relevant art, however, will readily recognize that the invention can be practiced without one or more of the specific details, or with other methods, etc. In other instances, well-known structures or operations are not shown in detail to avoid obscuring the invention.

Figure 1:
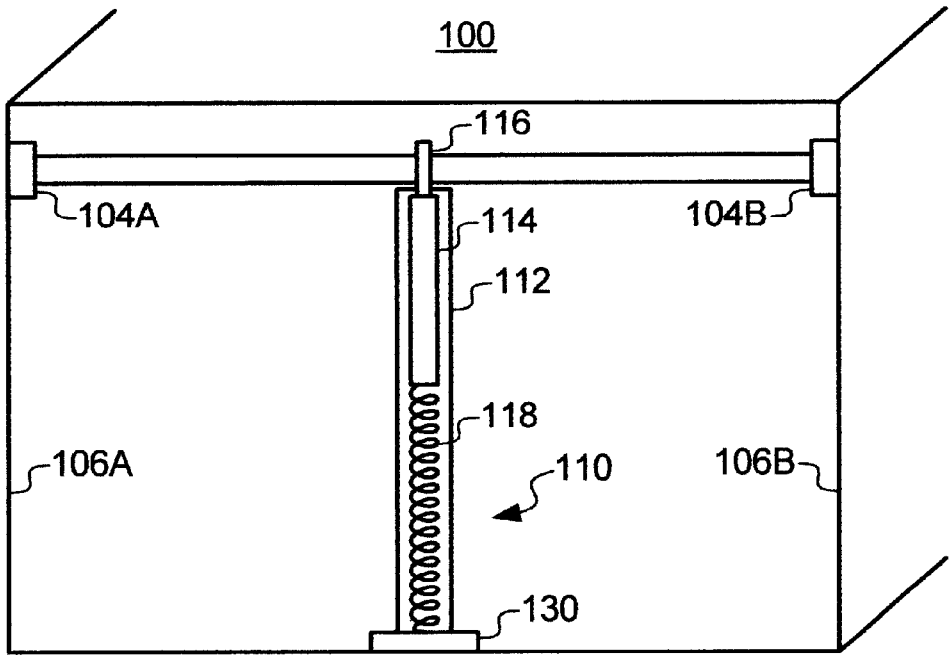
FIG. 1 is a fragmentary front view of a closet suitable for use with an embodiment of the invention.

FIG. 1 shows an environment of intended use for the rod support. FIG. 1 illustrates a front view of a closet 100 suitable for implementing an embodiment of the invention. For ease of explanation, the embodiments sometimes are described with respect to a clothes closet. However, it is to be understood that the invention can be implemented in various other environments, such as a bathroom, a laundry room, a beach house, etc.

The exemplar closet 100 has a rod 102. The rod 102 holds suits, dresses, coats, skirts, blouses, shoe bags, sweater racks, pants, etc. A typical closet rod is about six feet long.

Of course, the rod 102 does not have to be a closet rod. For example, the rod 102 can be a shower curtain rod, a towel rack, a clothing rack, etc., to accommodate wet towels, bathing suits, etc., as will be readily apparent to a person of ordinary skill in the art.

A pair of brackets 104A and 104B, respectively, are mounted on a pair of walls 106A and 106B, respectively. The rod 102 is positioned horizontally within the closet 100, with its ends seated within the pair of brackets 104A and 104B. In this configuration, the closet 100 houses the suits, dresses, coats, skirts, blouses, shoe bags, sweater racks, pants, etc., that are hung on the rod 102. Alternatively, towels, bathing suits, etc., are hung on the rod 102. As more items are hung on the rod 102, the rod 102, the brackets 104A and 104B, and the walls 106A and 106B are stressed and strained because of the weight of the items. Alternatively, the rod 102 is weakened because of age and use.

Example Embodiments

An exemplar rod support 110 according to the invention minimizes the stress borne by the rod, brackets, and walls. The rod support 110 is placed under the rod 102 to provide vertical support therefor.

In one embodiment, the rod support 110 includes a housing 112, an insert 114, and a cradle 116. The housing 112 admits and provides structural support for the component parts of the rod support 110. The housing 112 typically is about three feet in height.

The housing 112 can be a variety of shapes. For example, the housing 112 can be round, square, pentagonal, rectangular, hexagonal, etc. The housing 112 also can be made from a variety of materials. For example, the housing 112 can be steel, aluminum, or other sufficiently strong metal.

The insert 114 fits inside the housing 112 such that its movement within the housing 112 is telescopic. In one embodiment, the insert is positioned loosely inside the housing 112. That is, the insert 114 freely moves in and out of the housing 112 and may even wobble.

The insert 114 can be a variety of shapes, e.g., round, square, pentagonal, rectangular, hexagonal, etc. The insert 114 can be a tube or a solid rod. The shape of the insert 114 is limited only by the shape of the housing 112. For example, the diameter of the insert 114 should be small enough to permit the insert 114 to be positioned inside the housing 112.

It is not necessary that the insert 114 actually mate with the inner walls of the housing 112. For example, the insert 114 can have a threaded tip that mates with threads inside the housing 112. Accordingly, the insert 114 can be threaded to fit into the housing 112 for height adjustment. Moreover, the threaded connection can provide added structural support such that the insert 114 stands rigid within the housing 112.

The cradle 116 is mounted to the insert 114. The cradle 116 provides support for the rod 102. The cradle 116 holds the rod 102 in place such that the rod 102 is perpendicular to the cradle 116 and the insert 114. The cradle 116 can be a variety of shapes. The cradle 116 is described in further detail with reference to FIG. 2.

The rod support 110 has an adjustable height, typically from about four feet in height at its shortest to about ten feet in height. To increase the height, simply raise the insert 114 from the housing 112 to the height where the cradle 116 contacts the rod 102. Several embodiments implementing this feature are described below.

One embodiment includes a spring 118. The spring 118 fits into the housing 112. The spring 118 can be mounted to the cradle 116 or the insert 118. According to this embodiment, when the rod 102 rests on the cradle 116, the spring 118 compresses commensurately with the weight of the rod 102 and any items on the rod 102.

In this embodiment, the rod support 110 typically is about three feet in height when fully compressed. The rod support 110 typically is about six feet in height when the spring 118 is relaxed. Of course, primarily the weight of the rod 102 determines the height of the rod support 110.

The spring 118 can be any commonly available device of suitable length and tension that urges the insert 118 away from the housing 112 in a telescoping manner.

Still, another embodiment includes a base 130. The base 130 is mounted to the housing 112. The base 130 can be mounted permanently. Alternatively, the base 130 can be removable from the housing 112. For example, when the base 130 is a plate, the housing 112 can be welded or soldered to the base 130. Alternatively, the base 130 can have a threaded lip whereby the housing 112 can be threaded to fit into the base 130 for assembly and disassembly.

The base 130 enables the rod support 110 to maintain stability under a load. The base 130 can be a plate, a cup, a cap, etc., or any device suitable for maintaining stability. Moreover, the base 130 can be made from metal, rubber, plastic, etc., or any suitable material.

Figure 2:
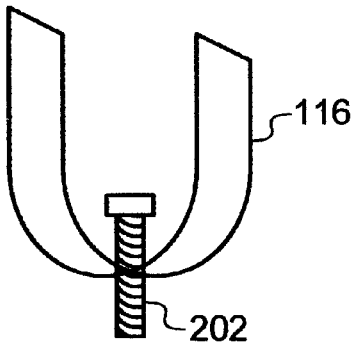
FIG. 2 also shows an exemplar connector for mounting a cradle to an insert.

FIG. 2, which shows an exemplar cradle 116 that is U-shaped. FIG. 2 also shows a connector 202 used to mount the cradle 116 to the insert 114. Of course, the connector 202 is not required for the invention. For example, the cradle 116 can be permanently mounted to the insert. Alternatively, the cradle 116 can be mounted to the housing 112.

Figure 3:
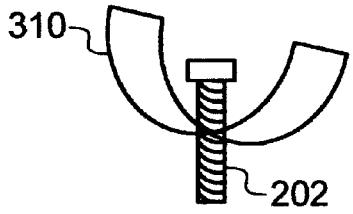
FIG. 3 depicts an exemplar cradle.
Figure 4:
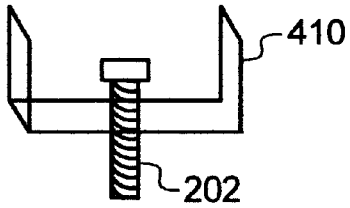
FIG. 4 depicts an exemplar cradle.

Other exemplar cradles are shown in FIG. 3 and FIG. 4. FIG. 3 shows a cradle 310 that is in the shape of a semicircle. FIG. 4 shows a cradle 410 in the shape of a semirectangle.

Figure 5:
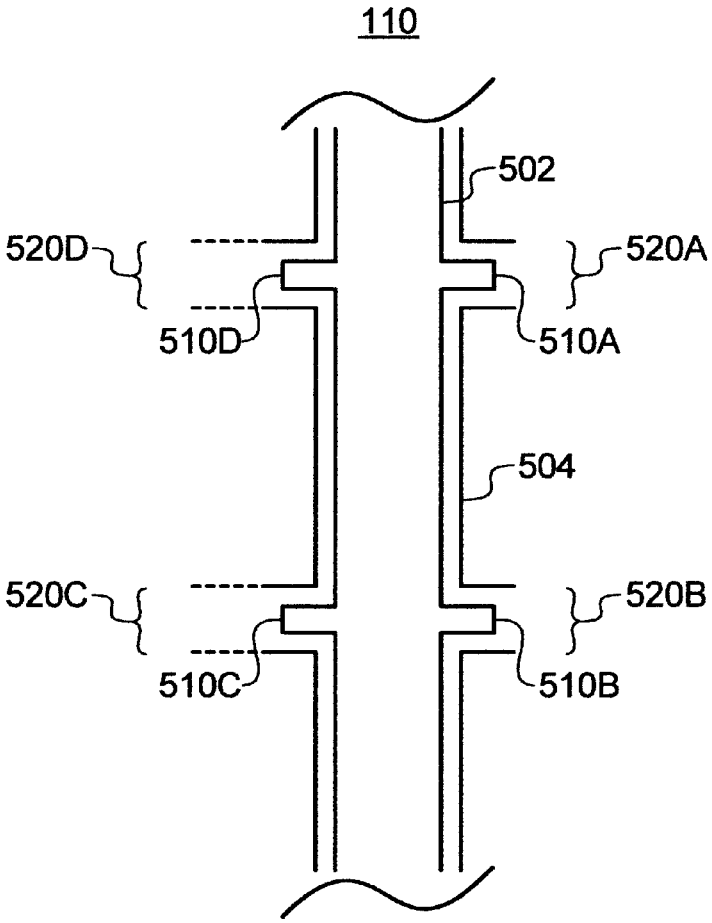
FIG. 5 depicts example protuberances and openings in the rod support.

The adjustable height feature can be implemented as shown in FIG. 5, which illustrates example protuberances and openings in the rod support 110. For example, in this embodiment, the insert 114 has one or more protuberances that correspond to one or more openings or recesses in the housing 112. The protuberances and openings permit the insert 114 to be raised and set into place in the housing 112 according to the positioning of the protuberances and corresponding openings or recesses.

FIG. 5 shows an insert 502 with four protuberances 510A, 510B, 510C, and 510D mating with a housing 504 with four openings 520A, 520B, 520C, and 520D. As FIG. 5 illustrates, the openings 520A, 520B, 520C, and 520D are designed such that the protuberances 510A, 510B, 510C, and 510D are visible on the outside of the housing 112. The insert 114 is raised and set into place in the housing 112 by placing the protuberances 510A, 510B, 510C, and 510D into the openings 520A, 520B, 520C, and 520D, respectively. The protuberances 510A, 510B, 510C, and 510D are locked into place within the openings 520A, 520B, 520C, and 520D.

All four sets of protuberances 510A, 510B, 510C, and 510D and openings 520A, 520B, 520C, and 520D need not be engaged. For example, the sets of protuberances 510A, 510B, 510C, and 510D and openings 520A, 520B, 520C, and 520D can be uniformly spaced apart from each other such that when only the first or top set of protuberances 510A, 510B, 510C, and 510D and openings 520A, 520B, 520C, and 520D is engaged, the rod support 110 is at its maximum height. When only the first and second sets of protuberances 510A, 510B, 510C, and 510D and openings 520A, 520B, 520C, and 520D are engaged, the rod support 110 is shorter than the maximum height.

The height can be adjusted according to the number and position of sets of protuberances 510A, 510B, 510C, and 510D and openings 520A, 520B, 520C, and 520D being engaged. It follows that when all sets of protuberances and openings are engaged, the rod support 110 is at its minimum height. Although embodiments are described with respect to four sets of sets of protuberances 510A, 510B, 510C, and 510D and openings 520A, 520B, 520C, and 520D, the invention is not so limited. For example, the rod support 110 can have any number of protuberances and corresponding openings.

Figure 6:
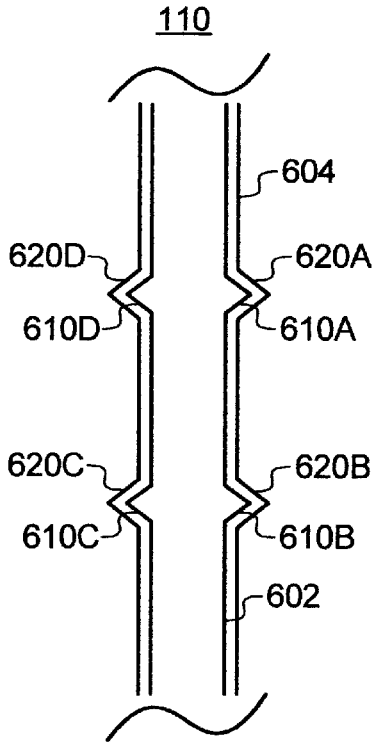
FIG. 6 depicts an example protuberances and recesses in the rod support.

FIG. 6 shows an insert 602 with four protuberances 610A, 610B, 610C, and 610D mating with a housing 604 with four recesses 620A, 60B, 620C, and 620D. The embodiment in FIG. 6 operates similarly to the embodiment in FIG. 5. As FIG. 6 illustrates, however, the recesses 620A, 60B, 620C, and 620D are closed such that the protuberances 610A, 610B, 610C, and 610D are not visible on the outside of the housing 112.

Figure 7:
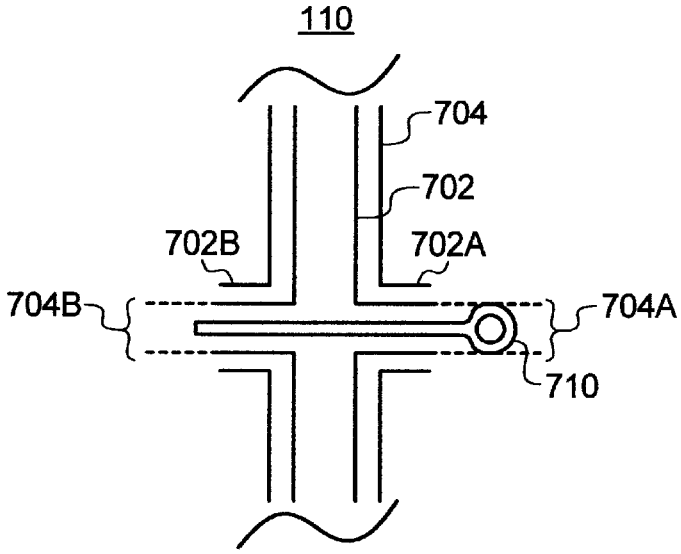
FIG. 7 depicts an example embodiment where the height is adjusted using holes and pins.

FIG. 7 illustrates an embodiment where an insert 702 has two or more openings 702A and 702B that correspond to two or more openings 704A and 704B in a housing 704. A pin 710 is inserted into the openings 702A and 702B and 704A and 704B to hold the insert 114 to a particular height.

The rod support 110 can be easily manufactured. For example, all protuberances, recesses, and openings can be aligned such that regardless of the implementation all pieces fit together. For example, the protuberances 510A, 510B, 510C, and 510D can be located in the same place on the rod support 110 as the protuberances 610A, 610B, 610C, and 610D. Similarly, the openings 520A, 520B, 520C, and 520D can be located in the same place on the rod support 110 as the recesses 620A, 620B, 620C, and 620D. The result is that the pieces of these two embodiments are interchangeable. The same is true for the openings 702A and 702B and 704A and 704B.

Figure 8:
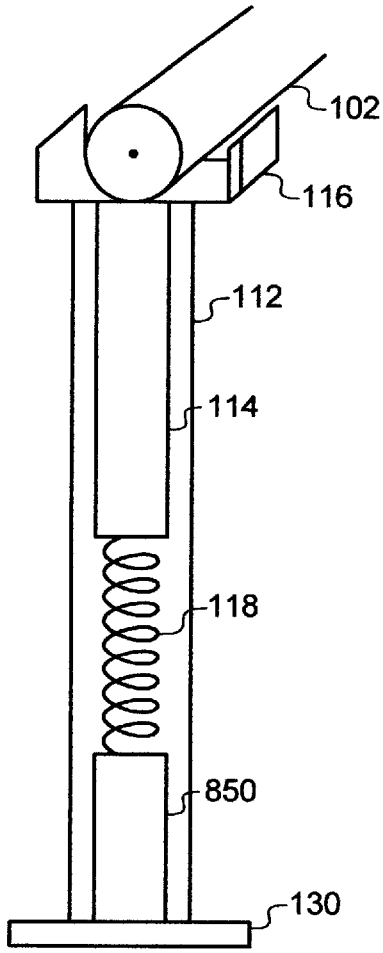
FIG. 8 depicts an example embodiment where the height is adjusted using a block.

FIG. 8 illustrates an embodiment where the rod support 110 includes a block 850. The block 850 is mounted to the housing 112. The block 850 can be mounted permanently. Alternatively, the block 850 can be removable from the housing 112. For example, when the block 850 is a plate, the housing 112 can be welded or soldered to the block 850. Alternatively, the block 850 can have a threaded tip whereby the block 850 can be threaded to fit into the housing 112 for assembly and disassembly.

The block 850 provides the rod support 110 with more height flexibility to accommodate various rod 102 positioning and various ceiling heights. The block 850 can be metal, rubber, plastic, etc., or any material suitable for maintaining stability.

This embodiment can be used for height adjustment as well. In this embodiment, to increase the height, simply unscrew the block 850 from the housing 112 to the height where the cradle 116 contacts the rod 102.

Figure 9:
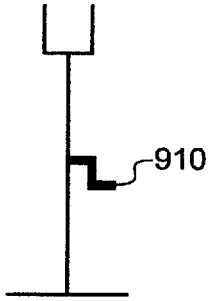
FIG. 9 depicts an example embodiment where the height is adjusted using a handle 910.

FIG. 9 illustrates an embodiment of a rod support 110 whose height is adjustable using a handle 910. The handle 910 operates a well-known winding or ratchet-like device to raise and lower the insert 114 into and out of the housing 112.

Similarly, in the embodiment where the insert 114 has a threaded tip that mates with threads inside the housing 112, the height of the rod support 110 can be adjusted. For example, to increase the height, simply unscrew the insert 114 from the housing 112 to the height where the cradle 116 contacts the rod 102.

Figure 10:
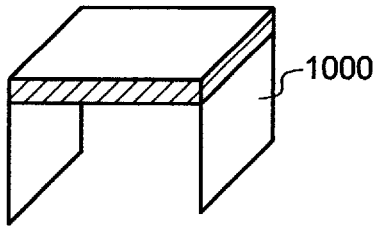
FIG. 10 is an example riser according to an embodiment of the present invention.

Alternatively, height can be adjusted using a riser that is positioned inside the cradle. FIG. 10 illustrates a riser 1000 suitable for implementing this embodiment. The riser 1000 mates with the cradle 410 and the rod 102 to minimize any gaps between the cradle 410 and the rod 102 created by not being precisely aligned with each other. The riser 1000 also minimizes any slippage between the cradle 410 and the rod 102.

Of course, the riser 1000 is not limited to the shape depicted in FIG. 10. For example, depending on the shape, the riser 1000 can fit inside the cradle 116, cradle 310, or any other shape that permits proper mating to minimizes gaps between the cradle and the rod.

NAMES OF PARTS AND REFERENCE NUMBERS

100 closet
102 rod
104A bracket
104B bracket
106A closet wall
106B closet wall
112 housing
114 insert
116 cradle
118 spring
130 base
202 connector
310 semi-circle shaped cradle
410 semi-rectangular shaped cradle
502 insert
504 housing
510A protuberance
510B protuberance
510C protuberance
510D protuberance
520A opening
520B opening
520C opening
520D opening
602 insert
604 housing
610A protuberance
610B protuberance
610C protuberance
610D protuberance
620A recess
620B recess
620C recess
620D recess
703 insert
704 housing
702A opening
702B opening
704A opening
704B opening
710 pin
850 block
910 handle

CONCLUSION

The invention has been described in language more or less specific as to structure and method features. It is to be understood, however, that the invention is not limited to the specific features described, since the means herein disclosed comprise example forms of putting the invention into effect. Various equivalent modifications are possible within the scope of the invention, as will be readily recognized by those skilled in the relevant art. Moreover, the invention is not intended to be limited except as by the claims.

What is claimed is:

1. A rod support comprising, a tubular housing;

a spring positioned inside the housing;

tubular insert positioned inside the housing and in contact with the spring, wherein the spring is arranged to urge the insert away from the housing in a telescoping manner;

a U-shaped cradle mounted to the insert to receive a horizontal rod; and such that when the cradle receives the rod the spring compresses commensurate with the weight of the rod.

2. The support of claim 1, further comprising a base mounted to the housing.

3. The support of claim 1, further comprising a rubber or metal base mounted to the housing.

4. The support of claim 1, further comprising a rectangular-shaped base mounted to the housing.

5. The support of claim 1, wherein the insert includes at least one protuberance and the housing includes at least one recess to receive the insert protuberance, wherein the recess comprises at least one of an opened recess or a closed recess.

6. The support of claim 1, further comprising a pin, wherein the insert and housing each includes at least one opening to receive the pin.

7. The support of claim 1, further comprising a support block positioned inside the housing and in contact with the spring.

8. A support for a clothes closet rod, comprising, a housing;

an insert positioned inside the housing;

a rod cradle mounted to the insert; and wherein a portion of the outside of the insert is threaded and a portion of the inside of the housing is threaded such that the threaded insert portion screws into the threaded housing portion.

9. The support of claim 8, further comprising a base mounted to the housing.

10. The support of claim 8, further comprising a rubber or metal base mounted to the housing.

11. The support of claim 8, further comprising a rectangular-shaped base mounted to the housing.

12. The support of claim 8, wherein the insert includes at least one protuberance and the housing includes at least one recess to receive the insert protuberance, wherein the recess comprises at least one of an opened recess or a closed recess.

13. The support of claim 8, further comprising a pin, wherein the insert and housing each includes at least one opening to receive the pin.

* * * * *